United States Patent [19]

Himukai

[11] Patent Number: 4,545,794

[45] Date of Patent: Oct. 8, 1985

[54] VACUUM CLEANER

[75] Inventor: Mamoru Himukai, Kasai, Japan

[73] Assignee: Sanyo Electric Co., Ltd., Osaka, Japan

[21] Appl. No.: 439,538

[22] Filed: Nov. 5, 1982

[30] Foreign Application Priority Data

Nov. 13, 1981 [JP] Japan ..... 56-182913
Jan. 11, 1982 [JP] Japan ..... 57-3184
Feb. 24, 1982 [JP] Japan ..... 57-29564

[51] Int. Cl.[4] ..... B01D 46/00; B01D 50/00

[52] U.S. Cl. ..... 55/362; 15/327 E; 15/352; 55/366; 55/372; 55/373; 55/377; 55/429; 55/433; 55/472; 55/482; 55/485; 55/DIG. 3

[58] Field of Search ..... 55/362, 372, 373, 376, 55/472, DIG. 3, 366, 374, 377, 429, 433, 482, 485; 15/327 E, 347, 352

[56] References Cited

U.S. PATENT DOCUMENTS 1,757,239 5/1930 Engberg et al. ..... 15/327 E X
2,534,280 12/1950 Lofgren ..... 55/362
2,672,210 3/1954 White ..... 55/372
2,719,600 10/1955 Brace ..... 55/374 X
2,794,513 6/1957 Hultberg et al. ..... 55/372 X
3,328,942 7/1967 Waters ..... 55/373 X
3,599,273 8/1971 Shirayanagi et al. ..... 55/472 UX
3,621,640 11/1971 Ohno et al. ..... 55/472 X
3,816,983 6/1974 Sawada et al. ..... 55/429 X

FOREIGN PATENT DOCUMENTS 35467 3/1977 Japan ..... 55/472
111660 9/1978 Japan ..... 15/347

*Primary Examiner*—Kathleen J. Prunner
*Attorney, Agent, or Firm*—Stiefel, Gross, Kurland & Pavane

[57] ABSTRACT

The present invention provides a vacuum cleaner comprising a body housing an electric powered blower, a dust case being connected to and free to be detached from the body, a lid having an intake and being fitted to the dust case, which lid is free to be opened and closed, a bag-shaped filter being freely fitted to and removable from the inner surface of the lid and communicating with the intake, and a dust dumping aperture provided in the dust case and accessible by pivoting away a filter housing unit, the dust dumping aperture being used to remove the bag-shaped filter from the dust case.

15 Claims, 12 Drawing Figures

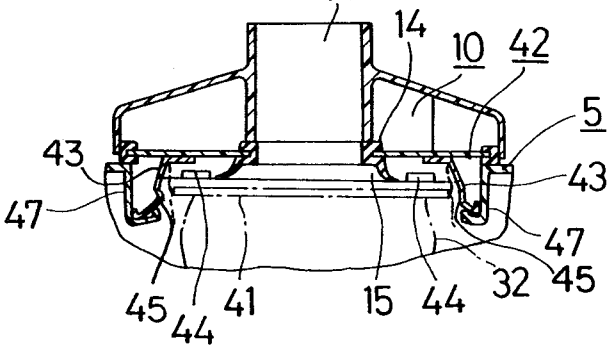
FIG. 5
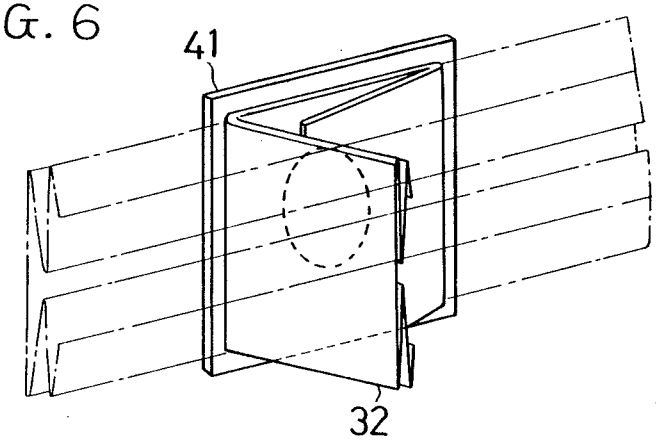
FIG. 6
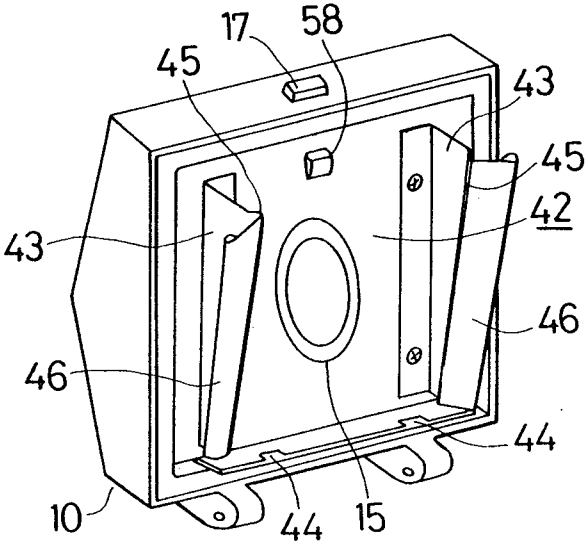

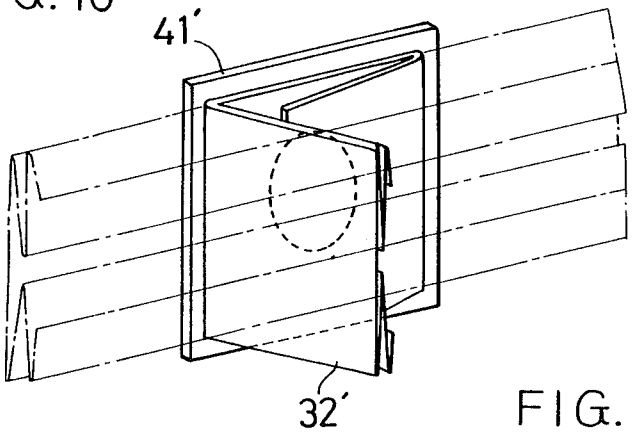
FIG. 10
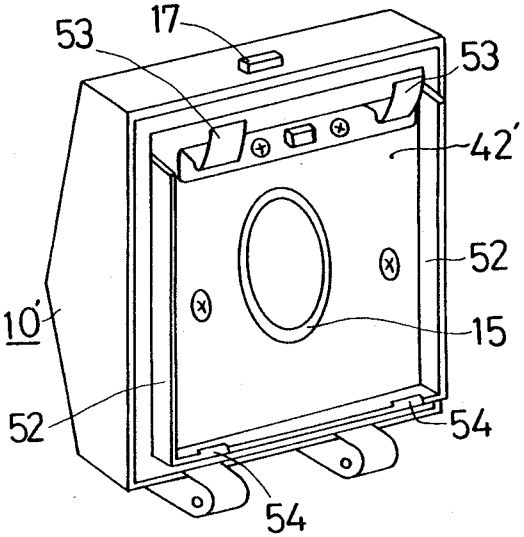
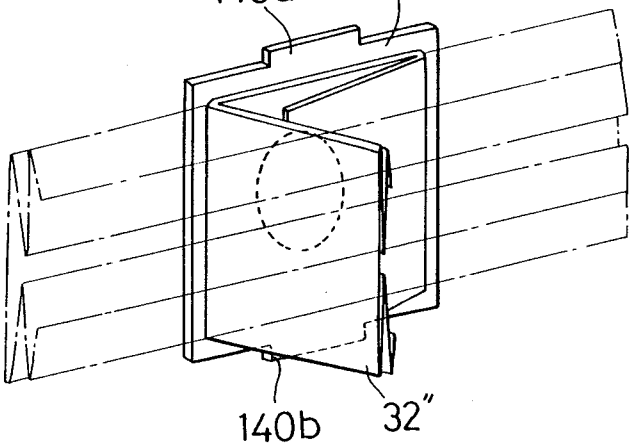
FIG. 11
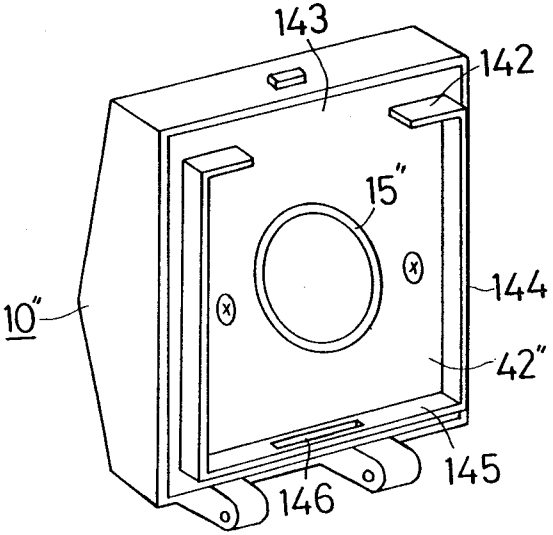

VACUUM CLEANER

BACKGROUND OF THE INVENTION

1. Field of the Invention

This invention relates to an improved vacuum cleaner wherein a bag-shaped filter such as a disposable paper bag is freely insertable into and removable from a dust case.

2. Description of the Prior Art

In the conventional vacuum cleaners using a bag-shaped filter, the insertion and removal of a bag-shaped filter is accomplished by opening and closing a lid fitted to a dust case, which lid has an intake, as disclosed in Japanese Patent Unexamined Publication No. 56(1981)-28734 and U.S. Pat. No. 3,873,285. Such vacuum cleaners have drawbacks, for example, when the bag-shaped filter located in the dust case is removed after dust has been collected, it is unsanitary, and the hands of the operator become dirty. This is because the filter must be removed by its open side. A further disadvantage is that when a large-sized bag-shaped filter designed to have more space for collecting dust is used, the full filter may catch onto the inner surface of the dust case during removal. Also, since the filter often must be pulled out by force, it is often torn, and dust is scattered about polluting the environment. Thus, vacuum cleaners designed for such small-sized bag-shaped filters tend to have fewer advantages as compared with those cleaners without a bag-shaped filter.

SUMMARY OF THE INVENTION

The present invention provides a vacuum cleaner comprising a body case housing an electric powered blower, a dust case defining a coarse dust collecting chamber and being open at both ends, one open end of which comprises the dust dumping aperture, said dust case being releasably secured to said body case, a lid having an intake and being hingedly attached to said dust case for movement between a closed and open position, a bag-shaped filter being freely insertable in and removable from the inside of said lid and communicating with said intake, and a dust dumping aperture being provided in said dust case and used to remove said bag-shaped filter from said dust case.

The vacuum cleaner of the present invention is designed so that the bag-shaped filter is removed by the rear of the filter instead of the open end (inlet side) by providing the dust dumping aperture in the dust case. This prevents the hands of an operator from becoming soiled and avoids spilling dust.

A structural feature of an embodiment according to the present invention is that the opening of the dust case covered by the lid is larger than the bag mouth plate attached to the bag-shaped filter. A holding means is provided near the opening, said holding means being capable of releasing the bag-shaped filter in order to take out the bag-shaped filter through the dust dumping aperture.

Another feature of the present invention is that the dust dumping aperture is covered by a filter housing unit which is hingedly attached to the dust case for movement between a closed position overlying the dust dumping aperture and an open position exposing the dust dumping aperture. The bag mouth plate holding means is designed to be released by linking with the turning motion of said filter unit. Thus, this feature of the invention increases the filtering effect and making the dust dumping operation simple.

A further feature of the invention is that a coarse dust collection area or chamber having a primary filter is formed between said filter unit and an inlet of the dust case. The filter housing unit defines a fine dust collection area or chamber, which communicates with the coarse dust collecting chamber. The filter housing unit is provided with a partition plate which separates the coarse and fine dust collecting areas. The partition plate also serves to maintain airflow through the dust case.

BRIEF DESCRIPTION OF THE DRAWINGS

FIG. 5 is a sectional view of the lid at the time of closure thereof;

FIG. 6 is a perspective view showing the relationship between the lid and the bag-shaped filter;

FIG. 10 and FIG. 11 are perspective views showing other embodiments which are similar to FIG. 6.

DETAILED DESCRIPTION OF THE PREFERRED EMBODIMENTS

An embodiment of the present invention is described in detail with reference to the accompanying drawings.

Figure 1:
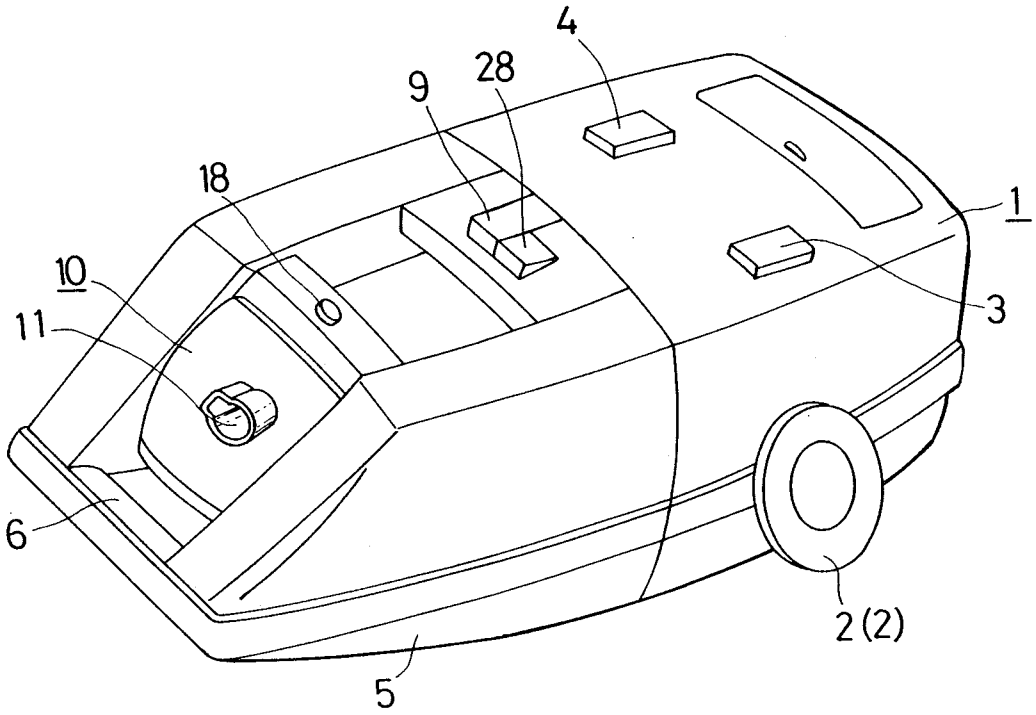
FIG. 1 is a perspective view showing an embodiment of the vacuum cleaner of the present invention.
Figure 2:
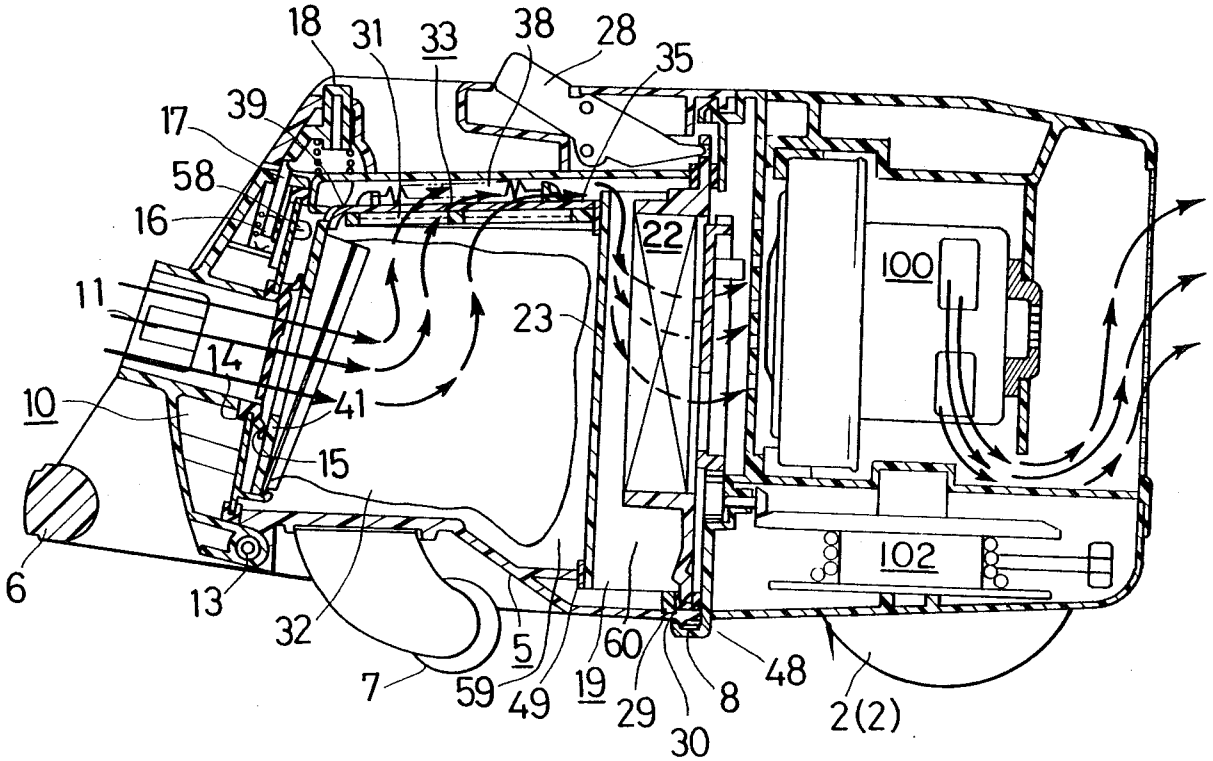
FIG. 2 is a partial broken sectional view of FIG. 1.

In FIGS. 1 and 2, 1 is a body case equipped with wheels 2(2) on both sides of its lower part. The body case houses an electric-powered blower 100 and a cord reel 102 and has a control button 3 for cord reel 102 and a switch button 4 on the upper surface. As shown, 5 is a dust case having a front handle 6 and a caster 7 located at the bottom. The dust case 5 is detachably connected to the body case 1 by means of a lower connecting part 8 and an upper clamp 9. 10 is a front lid having an intake 11. The lid 10 is hingedly attached to the dust case 5 for opening and closing, and is supported by a shaft 13 through a lid opening/closing spring 12 shown in FIG. 3 located at the lower front of said dust case 5.

14 is a packing for said intake 11. The packing for intake 11 has a circular airtight flange 15 which is an integral part of the packing. A clamp 17 is provided through a spring 16 at the upper part of said lid 10. The clamp is designed to be engaged with and disengaged from said dust case 5 by the control of a push button 18 located at the upper forward end of the dust case. 19 is a filter housing unit hingedly secured to the dust case 5 for opening and closing the back dust dumping aperture 20 (see FIG. 4). The filter unit 19 includes a corrugated main filter 22 supported by a filter supporting frame 21 and a non-permeable partition plate 23 located at the forward position, facing said intake 11. Main filter supporting parts 24 located at the upper part of said filter supporting frame 21 are fixed with shafts 26 through springs 25 to rings 127 located at an upper handle 126 fixed to the top surface of said dust case 5, and said filter unit 19 turns freely on the shafts 26 (see FIG. 7).

Figure 4:
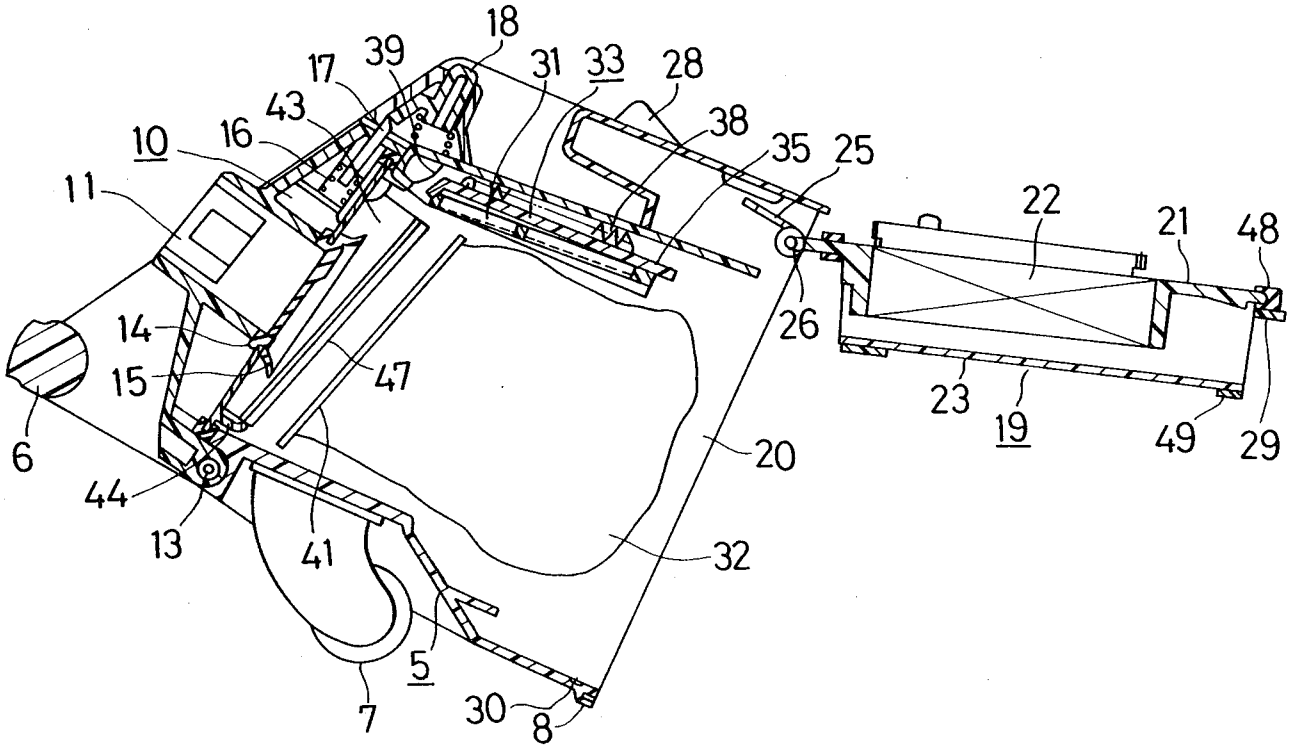
FIG. 4 is a sectional view of the dust case illustrating the dust dumping operation.
Figure 7:
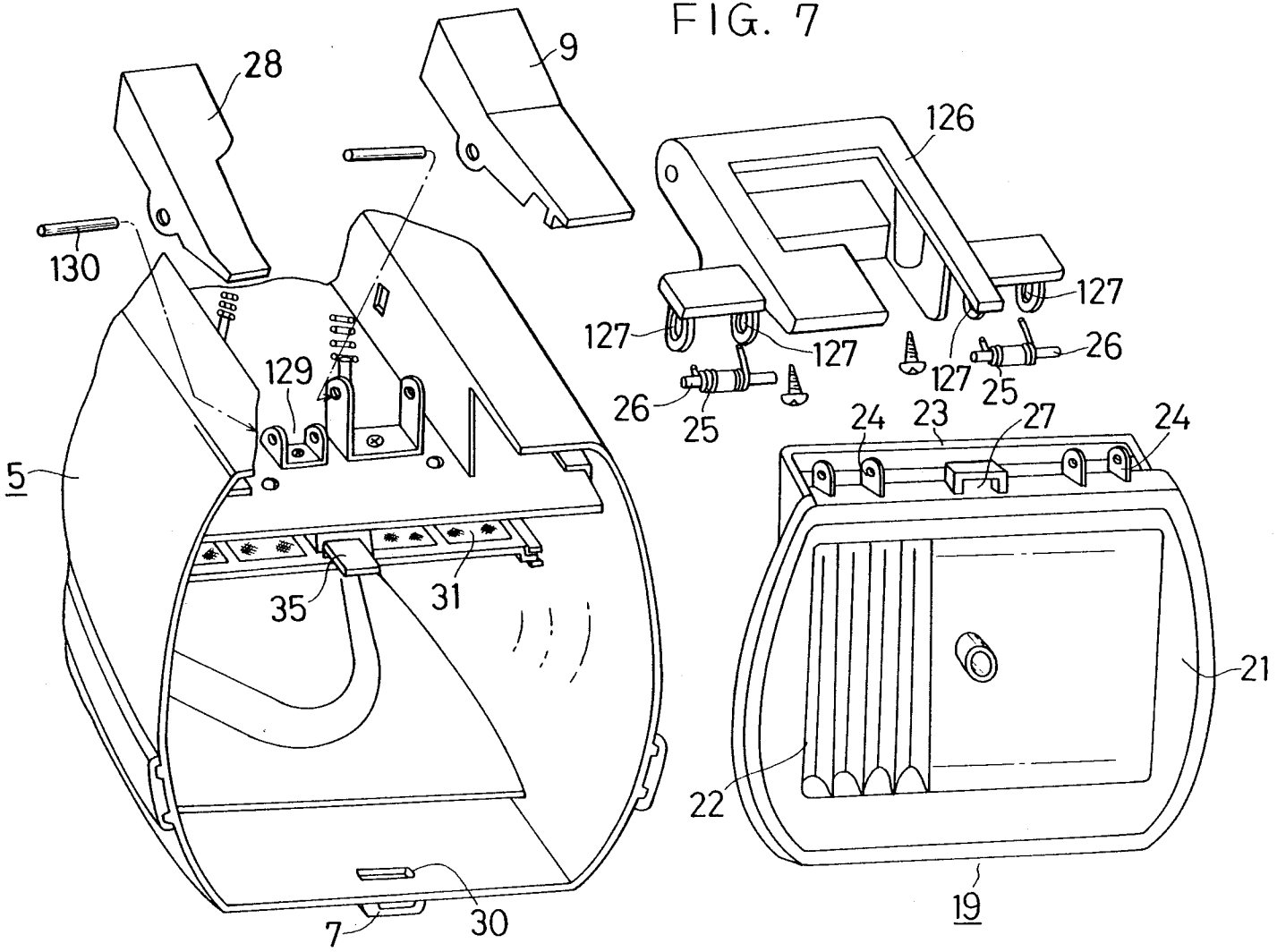
FIG. 7 is a perspective view showing the relationship between the filter housing unit and the dust case, both disassembled.

Interlocking of a lower locking piece 29 located at the bottom of said filter supporting frame 21 and lower groove 30 for interlocking 29 provided at the inner bottom of the dust case 5 is released by raising an upper groove 27 for interlocking located at the upper part of the filter supporting frame 21 with a clamp lever 28 (as best seen in FIGS. 2 and 7 capable of swinging on a shaft 130 fitted to metal fitting 129 located at the upper part of the dust case 5, and as shown in FIG. 4, the filter unit 19 is turned by the springs 25.

Figure 8:
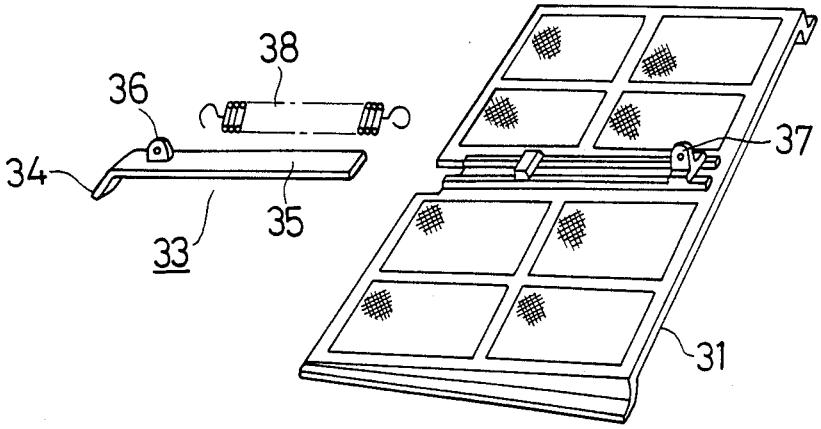
FIG. 8 is a perspective view of the primary filter and the bag mouth plate holding means both disassembled.

31 is a primary filter provided at the upper part of the inside of the dust case 5. Positioned above the primary filter 31 is a holding means 33 for a bag-shaped filter 32 such as a paper bag. The holding means 33 functions to inter-lock with the turning motion of the filter unit 19 and is capable of sliding above the primary filter 31. As best shown in FIG. 8, said holding means 33 includes a control lever 35, a locking piece 34 located at the end of this control lever 35, a rib 36 located on lever 35 and a spring 38 provided between said rib 36 and a rib 37 located on the primary filter 31, which spring pulls said control lever 35 backward. 39 is a projection located on the inner surface of the dust case 5. The projection 39 guides the control lever 35.

Provided at the rear of said lid 10 is a fitting part 42 where the bag mouth plate 41 of a bag-shaped filter 32, which is to be put in the dust case 5, is fitted. As best shown in FIG. 6, said fitting part 42 includes a pair of elastic plates 43, which are provided right and left and serve as a guide for the mouth plate 41 of said bag-shaped filter 32, and projections 44 which are located at the lower part of the lid 10 and serve to prevent drop. Said elastic plates 43, which are made of spring steel for example, each include a convex part 45 and a guide plate 46 which cooperate to guide said mouth plate 41 into position without holding it when interlocked. Installed at the both sides (right and left) of the front part inside the dust case 5 are guide walls 47 which release the mouth plate 41 of the said bag-shaped filter 32 by widening the elastic plates 43 when said lid 10 is closed. As best shown in FIG. 2, 48 is a seal packing fitted to the filter supporting frame 21, and 49 is a seal packing provided on the front surface of the non-permeable partition plate 23. For the filter housing unit 19 a freely rotating gear wheel 50 is provided. This also serves to remove dust from the main filter 22 by manual operation, and at the same time, the gear wheel 50 is connected to an intermediate gear 51 which interlocks with the cord reel 102, thereby making it possible to remove dust by the cord reel 102.

A further embodiment of the mouth plate fitting means 42' is described with reference to FIG. 10. Installed on the inner surface of lid 10' are a pair of guide plates 52 located right and left, a pair of elastic holding pieces 53 situated at the upper part and a pair of projections 54 for interlocking located at the lower part. A guide wall (not illustrated) is provided in the dust case. This guide wall releases the mouth plate 41' of a bag-shaped filter 32' by pushing up the elastic holding pieces 53 when said lid 10' is opened.

Another embodiment is described with reference to FIG. 11. A mouth plate fitting part 42'' on the inner surface of lid 10'' having an intake packing flange 15'' includes a square frame 144 having an opening 143 in the upper part of square frame 144 which also serves to guide the mouth plate 140 of a bag-shaped filter 32'' and a slot 146 dug in the lower part of square frame 144. Therefore, said mouth plate 140 can be positioned and held in the square frame 144 by setting projecting pieces **140*a* and 140*b* symmetrically at the upper and lower ends of the mouth plate 140 in the opening 143 and the slot 146 in the square frame 144 while grasping the mouth plate 140 of the folded bag-shaped filter 32''**.

Figure 9:
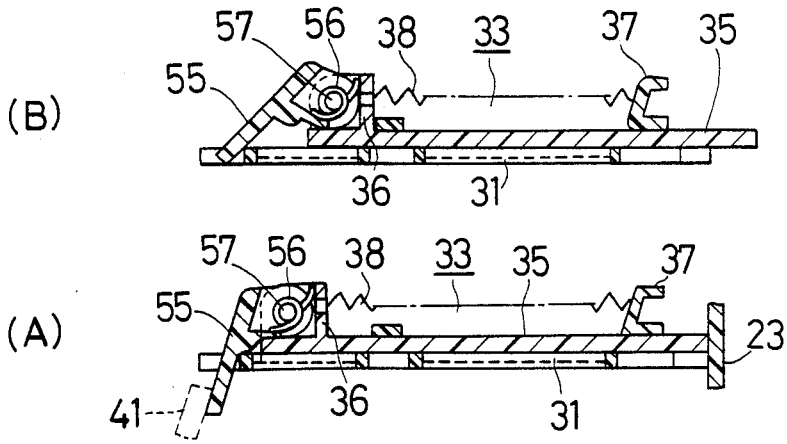
FIGS. 9(A) and 9(B) are sectional views showing the movement of another bag mouth plate holding means.

Yet another embodiment is described with reference to FIG. 9. The control lever 35 has a spring 56 which pushes a cam 55 downward. Thus when the partition plate 23 is released by the pivoting of the filter housing unit 19 rotating on supporting shaft 57, said cam 55 rotates and pressure on the mouth plate 41 of the bag-shaped filter 32 is released.

Following is an explanation of how the embodiment shown in FIGS. 1 through 8 is used.

Firstly, the use of a bag-shaped filter 32 such as a paper bag is described.

Figure 3:
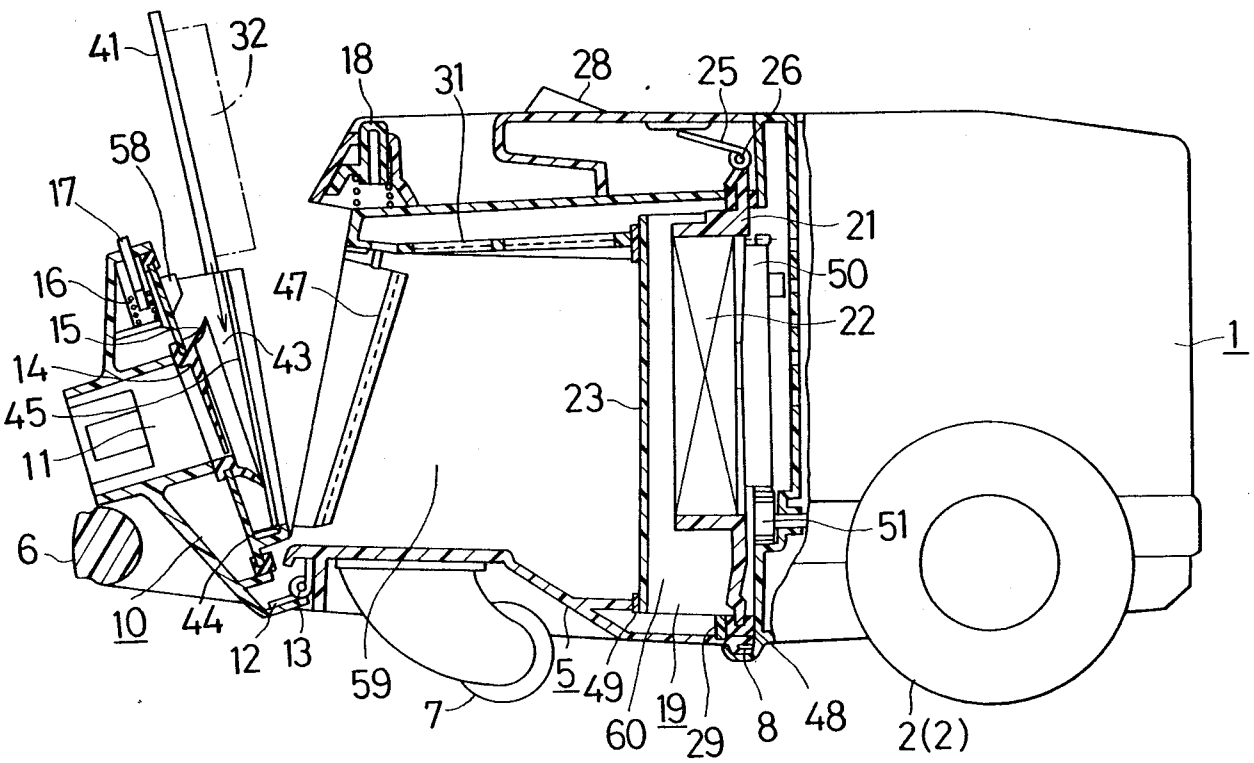
FIG. 3 is a partial broken sectional view of FIG. 2 at the time of installing the bag-shaped filter.

As shown in FIGS. 1–3, by pressing the push button 18, the clamp 17 located at the lid 10 moves downward against the spring 16 and releases the setting of the lid 10. Thus, as shown in FIG. 3, the lid 10 is opened forward by the force of the lid opening/closing spring 12, with shaft 13 functioning as a fulcrum.

Next, and referring to FIG. 6 as well the mouth plate 41 of the folded bag-shaped filter 32 is grasped and inserted along the guide of a pair of elastic plates 43 located right and left to reach the projections 44 situated at the lower end. Then the mouth plate 41 contacts the convex parts 45 of the elastic plates 43 and is held by the pressure of the airtight flange 15 of the packing 14 for intake 11. Therefore, when the lid 10 is closed, the bag-shaped filter 32 never slips.

When the lid 10 is engaged with the dust case 5, the elastic plates 43 (dotted lines in FIG. 5) are widened (solid lines in FIG. 5) by a pair of guide walls 47 located right and left in said dust case 5, and the mouth plate 41 is released. At the same time, because the end of the control lever 35 of the holding means 33 is projecting toward the opening side of the lid 10, the upper part of the mouth plate 41 of the bag-shaped filter 32 is caught and held by the projection 58 of said lid 10. The lower end of said mouth plate 41 is retained in position by the projections 44. Therefore, even if the lid 10 is opened after dust and dirt particles are collected, the mouth plate 41 of the bag-shaped filter 32 remains in place engaged by the projections 44 and the control lever 35 of the holding means 33. This feature permits the user to monitor the amount of dust and dirt particles collected inside the bag-shaped filter 32.

In use, the airflow through the vacuum cleaner according to the present invention is best shown by reference to FIG. 2. When blower 100 is activated, dirt mixed with air is drawn through air intake 11 and into the coarse dust collecting area 59. Airflow proceeds through primary filter 31 and into the fine dust collecting area 60. As shown in FIG. 2, filter housing unit 19 is provided with an opening in the upper end thereof for communicating the coarse dust collecting area 59 with the fine dust collecting area 60, such that when the filter housing unit 19 is in a closed position overlying dust dumping aperture 20, an airflow pathway between the dust collecting chambers is defined.

As best shown in FIG. 2, air flows from the fine dust collecting area 60 through the main filter 22, into the blower 100 and out of the vacuum cleaner through an outlet opening in the back of the body case 1.

Also as shown in FIG. 2, in a preferred embodiment, bag-shaped filter 32 is disposed within the coarse dust collecting area. With the bag in place, airflow through the unit proceeds in the same manner as described above. The air permeable bag does not inhibit airflow but serves to collect and retain coarse dust and dirt particles. When the bag-shaped filter 32 becomes full, the dust case 5 is separated from the body case 1 by pushing said upper clamp 9. If the dust case 5 is carried to a dumping place, such as a dust box, and the clamp lever 28 is pressed, the filter unit 19 turns as shown in FIG. 4 and the bag-shaped filter 32 can be thrown away.

In other words, by turning of the filter unit 19, the non-permeable partition plate 23 releases pressure on the holding means 33 and the control lever 35 is moved backward by the spring 38. Thus the upper part of the mouth plate 41 of the bag-shaped filter 32 is released. This permits the lower end of said mouth plate 41 to be lifted over the projections 44 and said bag-shaped filter 32 to be taken out from the dust dumping aperture 20. The holding means 33 is designed to move in a direction substantially parallel with the primary filter 31, the distance between the holding means 33 and the mouth plate 41 is sufficient to assure smooth one-touch removal of the bag without its being caught.

The vacuum cleaner according to the present invention can be operated without a bag-shaped filter 32 disposed within the dust case 5. In such a case, both dust and dirt particles collected in a coarse dust collecting area 59 and a fine dust collecting area 60 communicating with the dust collecting area 59 can be thrown away through the dust dumping aperture 20 by turning of the filter unit 19.

As described above, in the vacuum cleaner according to the present invention, the partition plate overlies the dust dumping aperture which faces the intake where the bag-shaped filter in the dust case is fitted and another filter is installed at the upper part of the dust case. As a result, dust and dirt particles collected in the bag-shaped filter first accumulate in the vicinity of the partition plate. Accordingly, clogging of the filter at the upper part by the airflow is retarded. Therefore the clogging of the whole bag-shaped filter can be avoided and good air-flow can be maintained.

In addition, since there is no need to provide a lot of ribs and the like in the dust case to secure an air passage for the bag-shaped filter, the bag-shaped filter can be removed through the dust dumping aperture without any trouble such as being caught by the ribs, being torn by them and so on. Furthermore, even when the cleaner is used without a bag-shaped filter, since the number of ribs is minimum, it is not feared that dust and dirt particles adhere to the ribs, and emptying the chamber is not difficult. Thus the cleaner can be used most effectively both with and without a bag-shaped filter.

The vacuum cleaner of this invention is applicable to a type that can move on a floor with wheels, a portable type that is carried with a band on the shoulder and so on.

The power source for the electric-blower 100 housed in the body case of these vacuum cleaners can be from an outlet by the use of a power cord, or from a storage battery housed in the cleaner if it is a portable type.

The bag of the bag-shaped filter can be of cloth or paper. The most suitable one is a disposable paper bag.

As presently contemplated, the mouth plate 41 of the bag-shaped filter is made of paper.

What is claimed is:

1. A vacuum cleaner comprising:

a body case defining a chamber having at least one opening at one end, said body case further defining an air outlet opening communicating with said chamber;

an electric-powered blower secured in said body case;

a dust case defining a coarse dust collecting chamber open at both ends;

means for releasably securing said body case to said dust case with one open end of said dust case in abutting confronting relation with said one end of said body case;

a primary air permeable filter secured in said dust case so as to partially define said coarse dust collecting chamber;

a lid having an air intake therein; and means for hingedly securing said lid to said dust case for movement between a closed position wherein the other open end of said dust case is covered by said lid and an open position wherein said other open end is exposed;

a filter housing unit defining a fine dust collecting chamber;

a second air permeable filter secured in said filter housing unit; and means for hingedly attaching said filter housing unit to said dust case for movement between a first position wherein said housing unit overlies said one open end of said dust case, and a second position wherein said one open end is exposed, said housing unit having an opening therein for communicating said coarse dust collecting chamber with said fine dust collecting chamber when said housing unit is in said first position, whereby when said lid is in said closed position and said housing unit is in said first position and said electric-powered blower is activated, air is drawn through said air intake into said coarse dust collecting chamber, through said primary air filter, through said fine dust collecting chamber, into said body case chamber through said second filter, and out through said air outlet opening.

2. The vacuum cleaner of claim 1, wherein said one open end of said dust case is located substantially opposite said lid.

3. The vacuum cleaner of claim 1, further comprising an air permeable dust bag having a bag mouth plate; and wherein said lid includes bag mouth plate fitting means for receiving said mouth plate of said dust bag.

4. The vacuum cleaner of claim 3, wherein said bag mouth plate is made of paper.

5. The vacuum cleaner of claim 3, and further comprising bag mouth holding means for releasably securing said dust bag to said fitting means, and said filter housing unit including means cooperating with said holding means for releasing said dust bag from said fitting means.

6. The vacuum cleaner of claim 5, wherein said dust bag releasing means comprises a linkage member extending above said primary filter and operating in response to movement of said filter housing unit to said second position.

7. The vacuum cleaner of claim 1, wherein said filter housing unit comprises a partition plate, and wherein said partition plate overlies said one open end of said dust case when said filter housing unit is in said first position.

8. A vacuum cleaner comprising:

a body case defining a chamber having at least one opening at one end, said body case further defining an air outlet opening communicating with said chamber;

an electric powered blower secured in said body case;

a dust case defining a coarse dust collecting chamber open at both ends;

means for releasably securing said body case to said dust case with one open end of said dust case in abutting confronting relation with said one end of said body case;

a primary air permeable filter secured in said dust case so as to partially define said coarse dust collecting chamber;

a lid having an air intake therein; and means for hingedly securing said lid to said dust case for movement between a closed position wherein the other open end of said dust case is covered by said lid and an open position wherein said other open end is exposed, the inner surface of said lid including a bag-mouth plate fitting means for receiving a dust bag when used;

a housing unit defining a fine dust collecting chamber; means for hingedly attaching said housing unit to said dust case for movement between a first position wherein said housing unit overlies said one open end of said dust case and a second position wherein said one open end of said dust case is exposed, said housing unit having an opening therein for communicating said fine and coarse dust collecting chambers when said housing unit is in said first position; and bag-mouth holding means for releasably securing said dust bag when used to said fitting means; and said housing unit defining means cooperating with said bag-mouth holding means for releasing the dust bag when used from the mouth plate fitting means to permit removal of said dust bag through said one end of said dust case when said dust case is released from said body case.

9. The vacuum cleaner of claim 8, further comprising a second filter secured in said housing unit.

10. The vacuum cleaner of claim 8, wherein said one open end of said dust case is located substantially opposite said lid.

11. The vacuum cleaner of claim 8, further comprising an air permeable dust bag having a bag mouth plate dimensioned for receipt by said fitting means.

12. The vacuum cleaner of claim 11, wherein said bag mouth plate is made of paper.

13. The vacuum cleaner of claim 8, wherein said housing unit comprises a partition plate, and wherein said partition plate overlies said one open end of said dust case when said housing unit is in said first position.

14. The vacuum cleaner of claim 13, wherein said dust bag releasing means comprises a linkage member extending above said primary filter and operating in response to movement of said housing unit to said second position.

15. The vacuum cleaner of claim 8, wherein said dust bag releasing means comprises a linkage member extending above said primary filter and operating in response to movement of said housing unit to said second position.

* * * * *